US006995518B2

(12) United States Patent
Havlik et al.

(10) Patent No.: US 6,995,518 B2
(45) Date of Patent: Feb. 7, 2006

(54) SYSTEM, APPARATUS, AND METHOD FOR DRIVING LIGHT EMITTING DIODES IN LOW VOLTAGE CIRCUITS

(75) Inventors: Steven M. Havlik, Robbinsdale, MN (US); Ernest F. Horning, Apple Valley, MN (US)

(73) Assignee: Honeywell International Inc., Morristown, NJ (US)

( * ) Notice: Subject to any disclaimer, the term of this patent is extended or adjusted under 35 U.S.C. 154(b) by 27 days.

(21) Appl. No.: 10/678,533

(22) Filed: Oct. 3, 2003

(65) Prior Publication Data

US 2005/0073263 A1 Apr. 7, 2005

(51) Int. Cl.
*G09G 3/10* (2006.01)

(52) U.S. Cl. ..... 315/169.3; 315/291; 315/307; 315/224; 327/355; 327/536; 345/102

(58) Field of Classification Search ..... 315/291, 315/307, 308, 224, 169.3, 169.1; 327/327, 327/361, 362, 514, 536, 331, 355; 361/56–58; 396/129, 205, 206; 345/82, 102, 212
See application file for complete search history.

(56) References Cited

U.S. PATENT DOCUMENTS

| | | | | |
|---|---|---|---|---|
| 6,116,512 | A * | 9/2000 | Dushane et al. | 236/51 |
| 6,486,726 | B1 * | 11/2002 | Worley et al. | 327/514 |
| 6,680,834 | B2 * | 1/2004 | Williams | 361/58 |
| 6,731,871 | B2 * | 5/2004 | Kitani et al. | 396/301 |
| 2004/0195978 | A1 * | 10/2004 | Horiuchi et al. | 315/291 |

* cited by examiner

*Primary Examiner*—Haissa Philogene
(74) *Attorney, Agent, or Firm*—Gregory M. Ansems

(57) ABSTRACT

A system, apparatus, and method for allowing LED operation in circuits operating with power supply levels that are below the forward voltage limits of the LED. A first level of a modulated voltage signal is applied to charge a voltage increasing component in a first phase of operation. A second level of the modulated voltage signal is then summed with the voltage stored across the voltage increasing component to provide adequate forward potential across Light Emitting Diode (LED) for illumination. The second level of modulated voltage is also used to provide a source of constant forward current to be conducted by LED when in its luminescent state.

24 Claims, 5 Drawing Sheets

SYSTEM, APPARATUS, AND METHOD FOR DRIVING LIGHT EMITTING DIODES IN LOW VOLTAGE CIRCUITS

FIELD OF THE INVENTION

This invention relates in general to Light Emitting Diode (LED) control, and more particularly to a system, apparatus, and method for driving the LED using a control circuit operating with a power supply lower than the forward voltage required by the LED.

BACKGROUND OF THE INVENTION

LEDs are used in a wide variety of applications from optical communications equipment to digital displays. In communications equipment, LEDs may be used to provide the light source required when propagating optical signal energy from one end of an optical fiber to the other end. In digital displays, for example, LEDs are becoming more pervasive for use in the backlighting that is required for Liquid Crystal Displays (LCD), or similar display units.

LCDs are found in everyday use such as in laptop computers, digital clocks and watches, microwave ovens, CD players, thermostats and many other electronic devices. These devices require displays to communicate pertinent information to the outside world, where LCDs are commonly used because they offer advantages over other display technologies, such as Cathode Ray Tubes (CRTs). Some of the advantages achieved by the LCD over the CRT display are that the LCD offers lighter, thinner design architectures using much less power than the CRT display.

The basic LCD is arranged as layers of polarized glass, electrodes, and liquid crystals, all of which are backlit. As varying voltages are applied to the electrodes of the LCD, the liquid crystals arrange themselves, e.g., "untwist" in the case of twisted nematic (TN) LCDs, in such a way as to allow the backlit light to pass through. Backlighting is required, therefore, in an LCD display to illuminate the design created by the electrically charged liquid crystal molecules.

Various methods are used today to provide the required backlighting for LCDs, including reflective, transmissive, and transflective methodologies. In the transmission and/or transflective categories, a number of different backlighting techniques are used, including incandescent, electroluminescent (EL), fluorescent, LED, and woven fiber optic lighting techniques, to name a few. Incandescent backlights are very bright, but generate a significant amount of undesirable heat. Additionally, the color of the incandescent light is very white, but is highly dependent upon the changing supply voltage.

EL backlighting is based on a solid state phenomenon, which uses colored phosphors to generate light. The main advantages offered by EL backlights include extremely low current requirements, very low heat generation, uniformity, and thinness. One disadvantage to the EL backlighting technique, however, is that an inverter is required, which itself requires up to 50–60 mA of supply current and additional circuit board space.

Fluorescent backlights offer very long lifetimes with low heat generation and low power consumption. Like an EL backlight, fluorescent backlights also require an inverter, but fluorescent backlights are not as sensitive to variations in supply voltage and withstand shock and vibration well.

LED backlighting is a popular choice, especially when relatively smaller LCDs are used. Some of the advantages of LED backlighting include its low cost, long life, and the wide variety of colors that are available. The light provided by the LEDs tends to be rather uneven, however, and a light pipe or light diffuser is often used to create increased uniformity. The forward current supplied to the LED should be regulated, in order to minimize intensity fluctuations due to power supply fluctuations.

As technology progresses, however, the designer is forced to work with increasingly challenging design constraints such as power, weight, and size restrictions. Power supply levels, for example, are particularly challenging with respect to driver circuits for the LED backlights. In particular, many of the electronic systems today are operating with supply voltages in the 3 volt range or less, whereas LEDs used in backlight circuitry, for example, require approximately 3.5–4 volts for proper operation. The designer, therefore, is faced with the arduous task of designing LED driver circuits using power supply voltage levels that offer less than the forward operating voltage required by the LED(s).

One solution to the problem is to provide power supply levels above the operating level of the components used in the particular electronic design. Reduced power supply levels, however, have many advantages for microelectronic design such as reduced quiescent and dynamic power consumption, reduced peak to peak variations in logic levels, and increased speed of operation. The advantages gained by the reduction of the power supply levels often outweigh the advantages gained from using higher power supply levels for driving LEDs, and thus does not provide a practical solution.

Another solution may be to design in other components having reduced power level requirements. The cost of redesign, however, may be prohibitive due to exorbitant component cost or lack of component availability.

Accordingly, there is a need for an apparatus, system and method that allows LED drivers to be used in electronic circuits operating with power supply levels below the specified forward voltage limits of the LEDs. The present invention fulfills these and other needs, and offers other advantages over the prior art.

SUMMARY OF THE INVENTION

To overcome limitations in the prior art described above, and to overcome other limitations that will become apparent upon reading and understanding the present specification, the present invention discloses a system, apparatus and method for utilizing LEDs in circuits operating with power supply levels less than the forward voltage requirements of the LED.

In accordance with one embodiment of the invention, a driver circuit for driving a component having an operating voltage greater than a magnitude of a voltage source is provided. The driver circuit comprises a voltage booster, such as a doubler, coupled to receive an input voltage and coupled to provide an output voltage having an increased magnitude relative to the input voltage, a current source coupled to receive the input voltage and coupled to provide a substantially constant current in response to the input voltage, and a component coupled to the voltage booster and the current source, wherein the voltage booster activates the component using the output voltage and the substantially constant current.

In accordance with another embodiment of the invention, a method of controlling backlighting associated with a display is provided. The method comprises storing charge from a power source in a first phase of operation when a bias voltage to at least one Light Emitting Diode (LED) is less than a forward voltage required by the LED. The power source provides a voltage level lower than the forward voltage required by the LED. In a second phase of operation, combining an operating voltage with the stored charge to illuminate the LED using the combined voltage as the bias voltage. The method further comprises alternating the first and second phases of operation to control the backlighting associated with the display.

In accordance with another embodiment of the invention, an environmental control system is provided. The environmental control system comprises a display controller coupled to the environmental control system to provide display information and a thermostat comprising an LCD coupled to receive the display information, and an LCD backlight system coupled to the LCD. The LCD backlight system comprises a voltage booster coupled to receive a lighting control signal and coupled to provide an output signal having an increased magnitude of the lighting control signal. The LCD backlight system further comprises a current source coupled to receive the lighting control signal and coupled to provide a substantially constant current in response to the lighting control signal and a Light Emitting Diode (LED) coupled to the voltage booster and the current source. The voltage booster activating the LED using the output signal and the substantially constant current.

In accordance with another embodiment of the invention, a method of controlling a luminescent state of a Light Emitting Diode (LED) is provided. The method comprises receiving an input signal, boosting the input signal to form a boosted signal, generating a substantially constant current from the input signal, and applying the boosted signal and the substantially constant current to illuminate the LED.

In accordance with another embodiment of the invention, a Light Emitting Diode (LED) control circuit is provided. The LED control circuit comprises means for charging an energy storage device during a first phase of operation of the LED control circuit and means for discharging the energy storage device during a second phase of operation of the LED control circuit to illuminate an LED. Means for discharging the energy storage device comprises means for summing the charge stored in the energy storage device with an illumination signal and means for supplying a constant current during the second phase of operation.

BRIEF DESCRIPTION OF THE DRAWINGS

The invention is described in connection with the embodiments illustrated in the following diagrams.

DETAILED DESCRIPTION OF THE INVENTION

In the following description, reference is made to the accompanying drawings which form a part hereof, and in which is shown by way of illustration particular embodiments in which the invention may be practiced. It is to be understood that other embodiments may be utilized, as structural and operational changes may be made without departing from the scope of the present invention.

Figure 1:
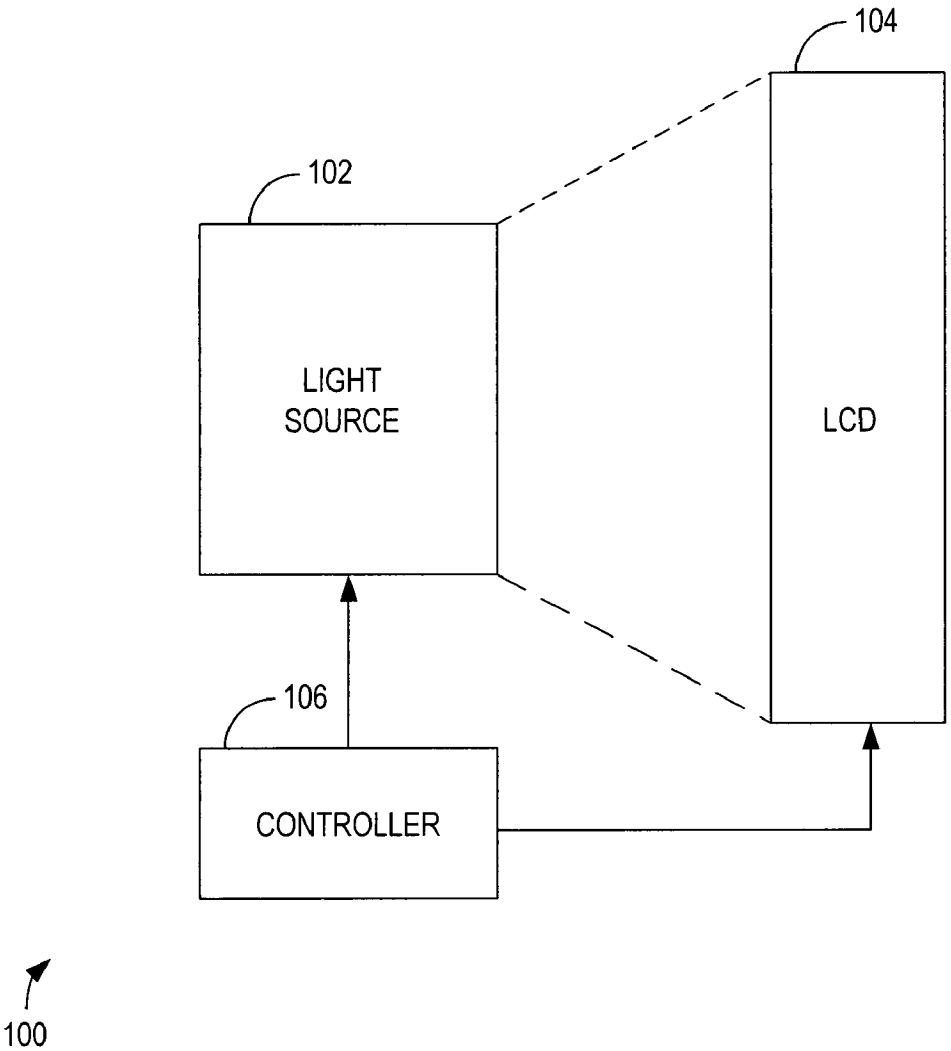
FIG. 1 is a block diagram of a display in accordance with the present invention.

FIG. 1 is a block diagram of display 100 in accordance with the principles of the present invention. Display 100 may be incorporated into any number of devices requiring the display of information such as hand-held computing devices, Personal Digital Assistants (PDA), laptop computers, electronic instrumentation, electronic games, thermostats, etc. Display 100 includes LCD 104 having light source 102 to provide the backlighting necessary for proper illumination of LCD 104. Controller 106 provides the control and/or data signals required by light source 102 and LCD 104 to display information as may be required by any devices incorporating display 100.

The operation of LCD 104 is made possible due to various physical phenomena including that light can be polarized; liquid crystals can transmit and change polarized light; the structure of liquid crystals can be changed by electric current; and certain transparent substances may conduct electricity. One example of the construction of LCD 104 incorporates two pieces of glass having a polarized film on one side of each piece of glass, where each piece of glass forms a filter. A special polymer is applied to both filters, opposite the side containing the polarizing film, that creates microscopic grooves in the surface of the glass in the same direction as the polarization. In one particular type of LCD, a coating of Twisted Nematic (TN) liquid crystals is then applied to one of the filters, where the grooves in the glass cause the liquid crystals to align with the orientation of the filter. The second filter is then added, where the polarization of the second filter is at a right angle to the polarization of the first filter. Each successive layer of TN molecules is slightly twisted with respect to the TN layer beneath until the uppermost layer is at a 90 degree angle with respect to the bottom filter. The orientation of the uppermost layer of TN molecules, therefore, matches the polarization of the top filter.

As light from light source 102 strikes LCD 104, it becomes polarized, where the TN molecules in each layer of LCD 104 guide the light to the next layer, changing the light's plane of vibration to match the angle of each respective TN molecule layer. When the light reaches the far side of LCD 104, it vibrates at the same angle as the final TN layer of molecules of LCD 104. Since the angle of liquid crystals in the final TN layer of molecules aligns with the polarization of the second filter, the light is allowed to project from LCD 104.

Interspersed within LCD 104 are transparent electrodes that are coupled to receive control signals from controller 106. The control signals apply an electric charge to the transparent electrodes causing the TN molecules to untwist. As the TN molecules untwist, they change the angle of light passing through them, so that the angle of the TN molecules at the top layer no longer matches the orientation of the polarization of the top filter. Consequently, no light may pass through the untwisted area, making it darker than the surrounding area. It can be seen, therefore, that through proper orientation of the electrodes, any design may be achieved on LCD 104 in response to the control signals from controller 106. Each electrode, for example, may represent a single pixel of the display surface of LCD 104, where controller 106 may control the illumination of each pixel of the display portion of LCD 104. Alternatively, negative images are generally provided in transmissive mode, where lighted characters/images are provided against an otherwise dark background.

Controller 106 also provides the required data and control signals to light source 102 for proper operation of display 100. Controller 106, for example, provides the power supply signals required to illuminate light source 102. Additionally, controller 106 provides the control signals required to control the intensity, for example, of light source 102. An on/off control signal may be supplied by controller 106, for example, that either fully illuminates light source 102 or fully darkens light source 102. By modulating the duty cycle of the on/off control signal, controller 106 is able to control the intensity of light source 102. For example, the on/off control signal may provide a nominal illumination intensity when light source 102 is turned on and off at a rate of 1 Kilohertz (kHz) with a 50% duty cycle. A 10% increase in the nominal illumination intensity is accomplished simply by increasing the duty cycle of the on/off control signal from 50% to 60%. Likewise, a 10% decrease in the nominal illumination intensity may be accomplished by decreasing the duty cycle of the on/off control signal from 50% to 40%.

Figure 2:
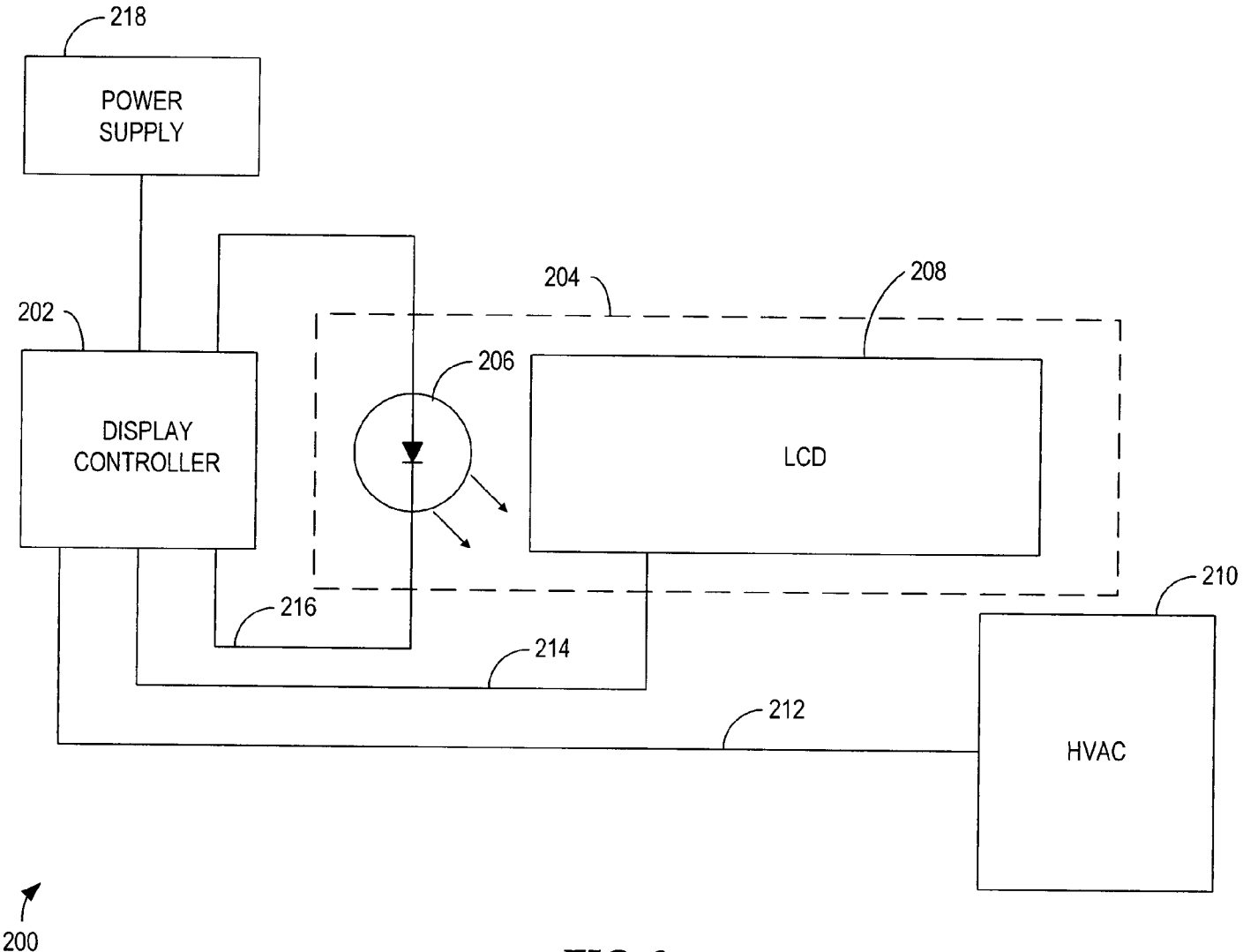
FIG. 2 is a block diagram of an HVAC system employing an LCD display in accordance with the present invention.

FIG. 2 illustrates an exemplary block diagram of Heating, Ventilating, and Air Conditioning (HVAC) control system 200, which utilizes thermostat 204 operating according to the present invention. In the illustrated embodiment, thermostat 204 includes an LCD display 208 and a backlight, where the backlight is implemented with an LED 206, or an array of LEDs. HVAC 210 may represent an HVAC unit used to control the environment of any home, office, business, building, or any other area that may require a controlled environment. Display controller 202 receives control information 212 from HVAC 210 equipment which in turn provides display information 214 to LCD 208 of thermostat 204. In addition, display controller 202 provides illumination and illumination intensity control information 216 to LED(s) 206 as required to correctly illuminate display information 214 using LCD 208.

Display Controller 202 operates in accordance with the present invention with respect to power supply 218. Power supply 218 may not, for example, provide an adequate level of voltage required to properly forward bias LED 206 during the illumination phase of LED 206, thereby disallowing proper backlighting of LCD 208 via the LED(s) 206. In accordance with the present invention, display controller 202 compensates for the inadequate voltage level established by power supply 218 by increasing the voltage available to the LED(s) 206.

It will be readily apparent to one of ordinary skill in the art from the description provided herein that the present invention, while illustrated in connection with an HVAC system, may also be used in virtually any backlight-based system requiring the display of data, text, graphics, or any combination thereof. Furthermore, although the present invention is illustrated for use with LED control circuits, the present invention may also be used in any system that requires compensation for inadequate power supply levels. Such a system, for example, exists in DC-DC converter applications, particularly for boost converter operation, where the input voltage is lower than the required regulated output voltage. The present invention may then be used, for example, to pre-boost the input voltage of the DC-DC converter to a level required for proper boost converter operation.

Figure 3:
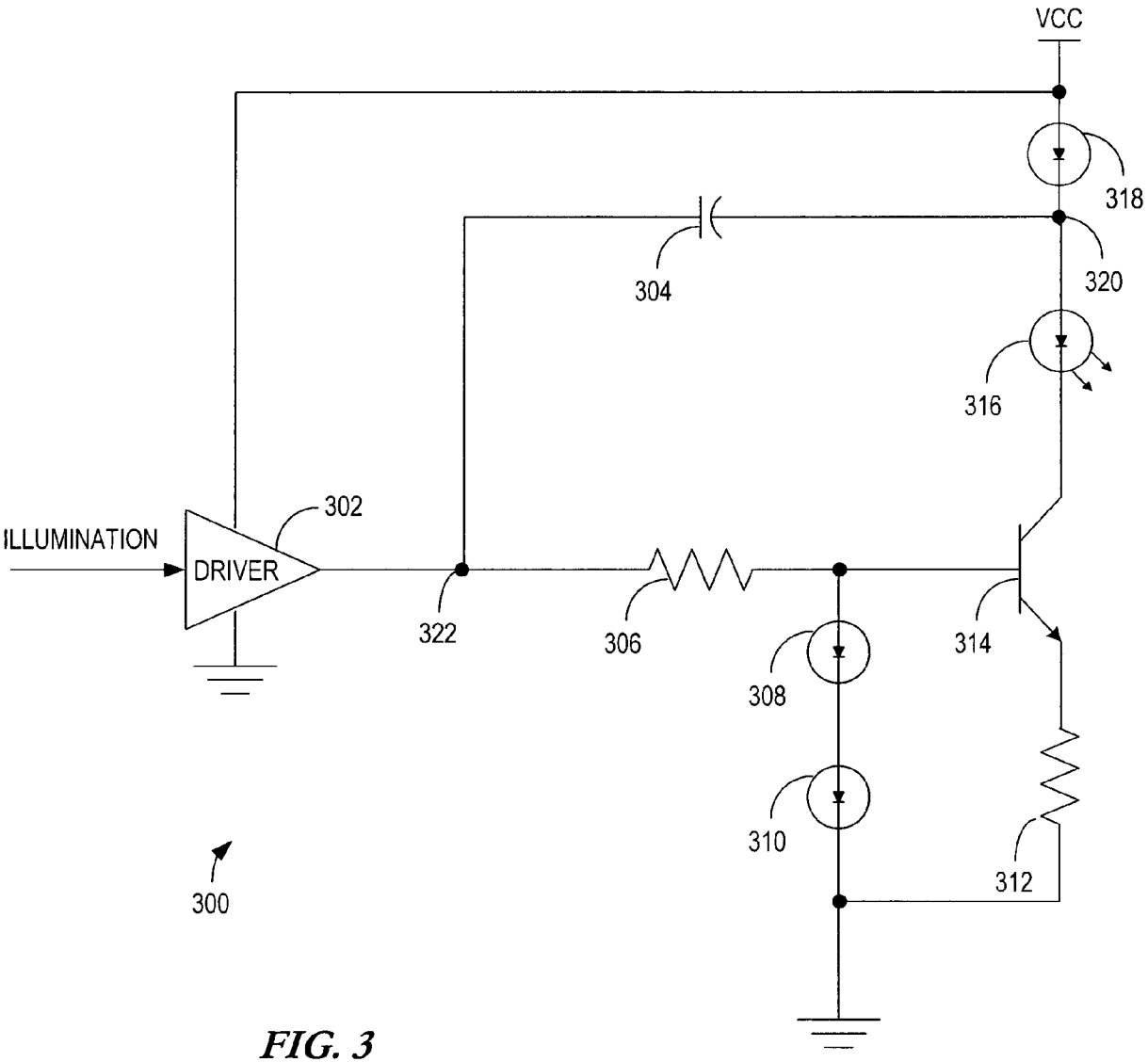
FIG. 3 is a schematic diagram of one embodiment of an LED driver circuit according to the present invention.

FIG. 3 illustrates a schematic diagram of one embodiment of an LED controller 300 according to the present invention, illustrating an NPN arrangement of transistor 314. Driver 302 is coupled to receive signal ILLUMINATION from, for example, display controller 202 of FIG. 2. Power supply $V_{CC}$ is coupled to the anode of diode 318 and to the power supply input of driver 302. The cathode of diode 318 is coupled to the anode of LED 316 at node 320 and to a first conductor of capacitor 304. A second conductor of capacitor 304 is coupled to the output of driver 302 at node 322 and to a first conductor of resistor 306. A second conductor of resistor 306 is coupled to the anode of diode 308 and the control terminal of transistor 314. The cathode of LED 316 is coupled to the collector, or first conductor of transistor 314. The emitter, or second conductor of transistor 314 is coupled to a first conductor of resistor 312. The cathode of diode 308 is coupled to the anode of diode 310. A second conductor of resistor 312 and the cathode of diode 310 are coupled to, for example, ground potential.

Driver 302 provides both push and pull operation at its output, such that current may be sourced and sinked, respectively, depending upon the logic value of signal ILLUMINATION. Driver 302 may, therefore, be implemented using Complimentary Metal Oxide Semiconductor (CMOS) logic. Input signal ILLUMINATION represents, for example, a CMOS signal with varying duty cycle, where driver 302 provides non-inverted buffering of signal ILLUMINATION.

In a first phase of operation, LED controller 300 serves to charge capacitor 304 or other capacitive element(s) when signal ILLUMINATION is at a logic low. Since driver 302 is a non-inverting driver in the illustrated embodiment, the output of driver 302 is also at logic low, or for example, approximately ground potential. It should be noted that the description provided herein is equally applicable to inverting drivers, as will be readily apparent to those skilled in the art from the description provided herein. The control terminal or base terminal of transistor 314 is at a logic low, thus placing transistor 314 into a substantially non-conductive state. During a first phase of operation, a current path is provided from power supply $V_{CC}$, to diode 318, to capacitor 304 and to ground potential, where ground potential is provided by the output of driver 302. Driver 302 is, therefore, in a sink mode of operation, thus sinking the current used to charge capacitor 304. Once capacitor 304 is adequately charged, a voltage approximately equal to $V_{CC}$–0.7 volts exists across capacitor 304, where a 0.7V voltage drop is assumed to exist across diode 318 during the first phase of operation. It should be noted that LED 316 is not in a luminescent state during the first phase of operation.

A second phase of operation exists when signal ILLUMINATION switches to a logic high. Since driver 302 in the present example is a non-inverting driver, the output of driver 302 is also at a logic high level substantially equal to $V_{CC}$. The initial voltage across capacitor 304 is the fully charged voltage acquired in phase one, which is equal to $V_{CC}$–0.7 volts. The initial voltage at node 320 at the beginning of the second phase of operation is, therefore, approximately equal to $2*V_{CC}$–0.7 volts. Thus, LED controller 300 has approximately doubled the level of supply voltage available at node 320 by first charging capacitor 304 to substantially the value of $V_{CC}$ during a first phase of operation and subsequently summing the voltage across capacitor 304 with the voltage at the output of driver 302, which is also substantially at $V_{CC}$.

Resistor 306 (or other resistive element), diodes 308–310, transistor 314, and resistor 312 combine to form a regulated, substantially constant current source during the second phase of operation. The voltage at node 322 is approximately equal to $V_{CC}$, thus allowing resistor 306 to forward bias diodes 308 and 310, which sets the voltage at the control terminal of transistor 314 to be substantially equal to two diode voltage drops above ground potential. The forward bias placed on the base-emitter junction of transistor 314 subsequently places transistor 314 into a conductive state, where resistor 312 limits the amount of emitter current, or equivalently LED 316 forward current, conducted by transistor 314. Solving the voltage equation around the loop including the base-emitter junction of transistor 314, the voltage across resistor 312 is calculated to be approximately equal to 0.7 volts, thus setting an emitter current approximately equal to $0.7/R_{312}$ amps, where $R_{312}$ is the resistance value of resistor 312. It should be noted that the emitter current conducted by transistor 314 is the sum of LED 316 forward current with the base current of transistor 314. However, with the selection of a reasonably high current gain for transistor 314, the effects of the base current may be neglected.

If diodes 308 and 310 are matched to the base-emitter junction of transistor 314, then the current conducted by resistor 312 is regulated by the junction voltages of diodes 308 and 310. Diode 308 effectively compensates for the base-emitter junction of transistor 314, while diode 310 regulates the voltage drop across resistor 312. Thus, the current conducted by resistor 312, which corresponds to the current conducted by LED 316, is regulated during the second phase of operation.

In operation, LED controller 300 either maintains a luminescent state of LED 316 by modulating the voltage applied at node 322, or maintains a non-luminescent state of LED 316 by keeping the voltage at node 322 at or sufficiently near ground potential. Maintaining a luminescent state of LED 316 is accomplished through the first and second phases of operation as discussed above, where capacitor 304 is charged during the first phase of operation and allowed to discharge during the second phase of operation. The illumination intensity of LED 316 is controlled by the duty cycle of the modulated voltage at node 322. For example, if the perceived intensity of LED 316 needs to be increased, then the voltage at node 322 should be held at a logic high for a longer duration within the modulation cycle, thereby keeping LED 316 illuminated in the second phase of operation for a longer percentage of time during the modulation cycle. If, on the other hand, the perceived intensity of LED 316 needs to be decreased, then the voltage at node 322 should be held at a logic high for a shorter duration within the modulation cycle, thereby keeping LED 316 illuminated in the second phase of operation for a shorter percentage of time during the modulation cycle. It should be noted that although the luminescent state of LED 316 is being modulated, the modulation rate is such that the human eye is substantially unable to perceive the toggling of luminescent states and/or is otherwise undetectable through the use of known light diffusion techniques. Rather, the human eye tends to average the luminescent states together such that the perceived intensity either increases with increased duty cycle, or decreases with decreased duty cycle.

During the second phase of operation in one embodiment of the invention, the voltage across capacitor 304 should be maintained such that the voltage at node 320 does not drop below a minimum threshold value, such that LED 316 is maintained in a luminescent state. The minimum threshold value being set by $V_{INIT}$, $V_{312}$, $V_{CE}$, and $V_{LED}$, where $V_{INIT}$ is the initial voltage at node 320 at the beginning of the second phase of operation, $V_{312}$ is the voltage drop across resistor 312, $V_{CE}$ is the collector-emitter voltage drop across transistor 314 and $V_{LED}$ is the forward operating voltage of LED 316. Exemplary values for $V_{CE}$ and $V_{LED}$ are 0.2 volts and 3.6 volts, respectively, the value of $V_{312}$ is regulated at 0.7 volts, and $V_{INIT}$ is calculated to be $2*V_{CC}-0.7$ volts.

One exemplary minimum threshold value of voltage at node 320, $V_{320}$, is readily calculated when $V_{CC}$ is taken to be, for example, 3.2 volts. $V_{320}$ at the beginning of the second phase of operation is approximately $V_{320}=V_{INIT}=5.7$ volts. $V_{320}$, however, begins to decay as capacitor 304 discharges current into node 320 during the second phase of operation. Diode 318 is reverse biased, thereby removing the $V_{CC}$ connection at node 320 and requiring capacitor 304 and driver 302 to provide the entire amount of constant forward current conducted by LED 316. Given that the minimum voltage across LED 316 for proper illumination should be, for example, 3.6 volts, the maximum amount of voltage decay across capacitor 304 is calculated to be $dV=V_{INIT}-V_{LED}-V_{CE}-V_{312}=1.2$ volts, thus the minimum threshold voltage at node 320 is calculated to be $V_{MIN_THRESH}=V_{INIT}-dV=4.5$ volts.

Once $V_{MIN_THRESH}$ is known, an exemplary value of capacitor 304 may be calculated using the equation $C_{304}=i*dt/dV$, where i is the constant current conducted by LED 316 during the second phase of operation and dt is the amount of time that the voltage at node 322 is held at a logic high during one modulation cycle. Given a modulation rate of 1 kHz, a duty cycle of 50%, and a constant current value of 5 milliamps (mA), for example, $C_{304}$ may be calculated to be $C_{304}=(0.5*10^{-3})*(0.5*10^{-3})/1.2=2.083$ micro-farads ($\mu$F).

In order to maximize the intensity of illumination of LED 316, the duty cycle of the modulated voltage at node 322 may be maximized. A minimum time, however, is required to charge capacitor 304 during the first phase of operation, which effectively limits the maximum duty cycle that is achievable. The minimum amount of time required to charge capacitor 304 for the above example may be calculated to be $dt=C_{304}*dV/i=(2.083*10^{-6})*(1.2)/(25*10^{-3})\sim100$ microseconds ($\mu$s), where it is assumed that the output of driver 302 is able to sink 25 mA of current used to charge capacitor 304 during the first phase of operation.

It should be noted that if $V_{CC}$ is supplied as a regulated voltage, then diodes 308 and 310 may be replaced with a resistance, and in a more particular embodiment with a single resistor, thus further reducing the part count of LED controller 300. In addition, a single resistor allows for a smaller potential to be formed across resistor 312, thus improving the maximum allowable voltage decay, dV, across capacitor 304 during the second phase of operation. Furthermore, diode 318 may be implemented with a Schottky diode having a lower barrier potential than conventional diodes, thus increasing $V_{INIT}$ at the beginning of the second phase of operation.

It should also be noted that although a voltage doubling operation is described, any amount of potential developed at node 320 may be adequate as long as $V_{320}$ exceeds $V_{MIN_THRESH}$. In other words, the voltage developed across capacitor 304 during phase one may be a voltage that is less than $V_{CC}$, but may still allow $V_{320}$ to exceed $V_{MIN_THRESH}$. A luminescent state of LED 316 may, therefore, be achieved when the voltage across capacitor 304 exceeds a minimum voltage. For example, taking the values of $V_{CC}$ and $V_{MIN_THRESH}$ as discussed above, the minimally acceptable capacitor 304 voltage, $V_{304MIN}$, is calculated to be $V_{304MIN}=V_{MIN_THRESH}-V_{CC}=4.5-3.2=1.3$ volts. Accordingly, any voltage developed across capacitor 304 between 1.3 volts and a maximum voltage substantially equal to $V_{CC}$ is adequate to illuminate LED 316. Driver 302, in combination with capacitor 304, therefore, are said to be boosting the voltage at node 320 to any value between $V_{MIN_THRESH}$ and substantially $2*V_{CC}$ in order to achieve a luminescent state of LED 316.

Figure 4:
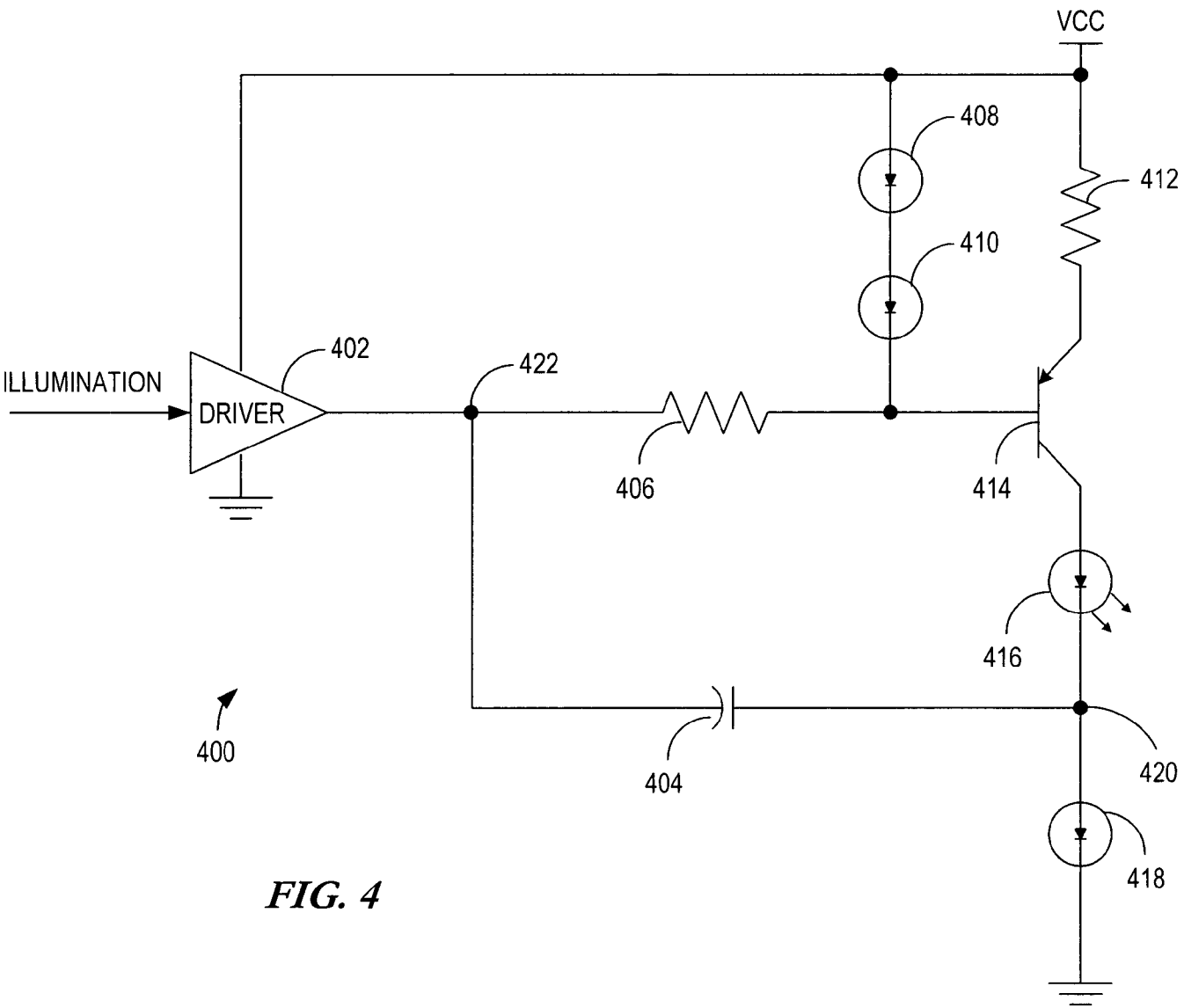
FIG. 4 is a schematic diagram of another embodiment of an LED driver circuit according to the present invention.

FIG. 4 illustrates a schematic diagram of another embodiment of an LED controller 400 according to the present invention, illustrating a PNP arrangement of transistor 414. Driver 402 is coupled to receive signal ILLUMINATION from, for example, display controller 202 of FIG. 2. Power supply $V_{CC}$ is coupled to the anode of diode 408, a first conductor of resistor 412 and to the power supply input of driver 402. The cathode of diode 408 is coupled to the anode of diode 410. The cathode of diode 410 is coupled to the control terminal of transistor 414 and a first conductor of resistor 406. A first conductor of capacitor 404 is coupled to a second conductor of resistor 406 at node 422 and the output of driver 402. A second conductor of capacitor 404 is coupled to the cathode of LED 416 at node 420 and to the anode of diode 418. The cathode of diode 418 is coupled to, for example, ground potential. A second conductor of resistor 412 is coupled to the emitter, or first conductor of transistor 414. The collector, or second conductor of transistor 414 is coupled to the anode of LED 416.

Driver 402 provides both push and pull operation at its output, such that current may be sourced and sinked, respectively, depending upon the logic value of signal ILLUMINATION. Driver 402 may, therefore, be implemented using CMOS logic. Input signal ILLUMINATION represents, for example, a CMOS signal with varying duty cycle, where driver 402 provides non-inverted buffering of signal ILLUMINATION.

In a first phase of operation, LED controller 400 serves to charge capacitor 404, when signal ILLUMINATION is at a logic high. Since the illustrated driver 402 represents a non-inverting driver, the output of driver 402 is also at logic high, or substantially equal to $V_{CC}$. The control terminal or base terminal of transistor 414 is at a logic high, thus placing transistor 414 into a non-conductive state. During the first phase of operation, a current path is provided from the output of driver 402 at node 422, to capacitor 404, to diode 418, and to ground potential. Driver 402 is, therefore, in a source mode of operation, thus sourcing the current used to charge capacitor 404. Once capacitor 404 is charged, a voltage approximately equal to $V_{CC}-0.7$ volts exists across capacitor 404, where a 0.7V voltage drop is assumed to exist across diode 418 during the first phase of operation. It should be noted that LED 416 is not in a luminescent state during the first phase of operation.

A second phase of operation exists when signal ILLUMINATION switches to a logic low. Since driver 402 in the present example is a non-inverting driver, the output of driver 402 is also at a logic low level, for example, ground potential. The initial voltage across capacitor 404 is the fully charged voltage acquired in phase one, which is $V_{CC}-0.7=2.5$ volts. The initial voltage at node 420, $V_{INIT}$, at the beginning of the second phase of operation is, therefore, $V_{INIT}=V_{CC}-0.7$ volts below ground potential. Diode 418 becomes reverse biased at the beginning of the second phase of operation, thus allowing the negative voltage at node 420 to exist. LED controller 400 has therefore substantially doubled the power supply range by effectively extending the reference voltage from ground potential to $V_{INIT}=-(V_{CC}-0.7)=-2.5$ volts.

Resistor 406, diodes 408-410, transistor 414, and resistor 412 combine to form a regulated, substantially constant current source during the second phase of operation. The voltage at node 422 is approximately equal to ground potential, allowing resistor 406 to forward bias diodes 408 and 410, thus setting the voltage at the control terminal of transistor 414 to be approximately equal to two diode voltage drops below $V_{CC}$. The forward bias placed on the emitter-base junction of transistor 414 subsequently places transistor 414 into a conductive state, where resistor 412 limits the amount of emitter current, or equivalently the amount of LED 416 current, conducted by transistor 414. Solving the voltage equation around the loop including the emitter-base junction of transistor 414, the voltage across resistor 412 is calculated to be approximately 0.7 volts, thus setting an emitter current approximately equal to $0.7/R_{412}$ amps, where $R_{412}$ is the resistance value of resistor 412. It should be noted that the emitter current conducted by transistor 414 is the sum of LED 416 forward current with the base current of transistor 414. However, with the selection of a reasonably high current gain for transistor 414, the effects of the base current may be neglected.

If diodes 408 and 410 are matched to the emitter-base junction of transistor 414, then the current conducted by resistor 412 is regulated by the junction voltages of diodes 408 and 410. Diode 410 effectively compensates for the emitter-base junction of transistor 414, while diode 408 regulates the voltage drop across resistor 412. Thus, the current conducted by resistor 412, which corresponds to the current conducted by LED 416, is regulated during the second phase of operation.

In operation, LED controller 400 either maintains a luminescent state of LED 416 by modulating the voltage applied at node 422, or maintains a non-luminescent state of LED 416 by keeping the voltage at node 422 at approximately $V_{CC}$. Maintaining a luminescent state of LED 416 is accomplished through the first and second phases of operation as discussed above, where capacitor 404 is charged during the first phase of operation and allowed to discharge during the second phase of operation. The illumination intensity of LED 416 is controlled by the duty cycle of the modulated voltage at node 422. For example, if the perceived intensity of LED 416 needs to be increased, then the voltage at node 422 should be held at a logic low for a longer duration within the modulation cycle, thereby keeping LED 416 illuminated in the second phase of operation for a longer percentage of time during the modulation cycle. If, on the other hand, the perceived intensity of LED 416 needs to be decreased, then the voltage at node 422 should be held at a logic low for a shorter duration within the modulation cycle, thereby keeping LED 416 illuminated in the second phase of operation for a shorter percentage of time during the modulation cycle.

During the second phase of operation in one embodiment, the voltage across capacitor 404 should be maintained such that the voltage at node 420 does not increase above a maximum threshold value. The maximum threshold value being set by $V_{CC}$, $V_{INIT}$, $V_{412}$, $V_{EC}$, and $V_{LED}$, where $V_{INIT}$ is the initial voltage at node 420 at the beginning of the second phase of operation, $V_{412}$ is the voltage drop across resistor 412, $V_{EC}$ is the emitter-collector voltage drop across transistor 414 and $V_{LED}$ is the forward operating voltage of LED 416. Exemplary values for $V_{CE}$ and $V_{LED}$ are 0.2 volts and 3.6 volts respectively, the value of $V_{412}$ is regulated at 0.7 volts, and $V_{INIT}$ is calculated to be $V_{INIT}=-(V_{CC}-0.7)=-2.5$ volts.

One exemplary maximum threshold value of voltage at node 420, $V_{420}$, is readily calculated when $V_{CC}$ is taken to be, for example, 3.2 volts. $V_{420}$ at the beginning of the second phase of operation is approximately $V_{420}=V_{INIT}=-2.5$ volts. $V_{420}$, however, begins to decay to ground potential as capacitor 404 discharges current into node 422 during the second phase of operation. Diode 418 is reverse biased, thereby removing the ground connection at the cathode of diode 418 and requiring capacitor 404 and driver 402 to sink the entire amount of constant forward current conducted by LED 416. Given that the minimum voltage across LED 416 for proper illumination should be, for example, 3.6 volts, the maximum amount of voltage decay across capacitor 404 is calculated to be $dV=V_{CC}-V_{412}-V_{EC}-V_{LED}-V_{INIT}=1.2$ volts, thus the maximum threshold voltage at node 420 is calculated to be $V_{MAX_THRESH}=dV+V_{INIT}=-1.3$ volts.

Once $V_{MAX_THRESH}$ is known, an exemplary value of capacitor 404 may be calculated using the equation $C_{404}=i*dt/dV$, where i is the constant current conducted by LED 416 during the second phase of operation and dt is the amount of time that the voltage at node 422 is held at a logic low during one modulation cycle. Given a modulation rate of 1 kHz, a duty cycle of 50%, and a constant current value of 5 mA, for example, $C_{404}$ may be calculated to be $C_{404}=(5*10^{-3})*(0.5*10^{-3})/1.2=2.083\ \mu F$.

In order to maximize the intensity of illumination of LED 416, the duty cycle of the modulated voltage at node 422 may be minimized. A minimum time, however, is required to charge capacitor 404 during the first phase of operation, which effectively limits the minimum duty cycle that is achievable. The minimum amount of time required to charge capacitor 404 for the above example may be calculated to be $dt=C_{404}*dV/i=(2.083*10^{-6})*(1.2)/(25*10^{-3})\sim 100\ \mu s$, where it is assumed that the output of driver 402 is able to source 25 mA of current to charge capacitor 404 during the first phase of operation.

It should be noted that if $V_{CC}$ is supplied as a regulated voltage, then diodes 408 and 410 may be replaced with a resistance, such as a single resistor which further reduces the part count of LED controller 400. In addition, the single resistor allows for a smaller potential to be formed across resistor 412, thus improving the maximum allowable voltage decay, dV, across capacitor 404 during the second phase f operation. Furthermore, diode 418 may be implemented with a Schottky diode having a lower barrier potential than conventional diodes, thus decreasing $V_{INIT}$ at the beginning of the second phase of operation.

It should also be noted that although a voltage doubling operation is described, any amount of potential developed at node 420 may be adequate as long as $V_{420}$ does not exceed $V_{MAX_THRESH}$. In other words, the voltage developed across capacitor 404 during phase one may be a voltage that is less than $V_{CC}$, but may still allow $V_{420}$ to remain below $V_{MAX_THRESH}$ during the second phase of operation. A luminescent state of LED 416 may, therefore, be achieved when the voltage across capacitor 404 exceeds a minimum voltage. For example, taking the values of $V_{CC}$ and $V_{MAX_THRESH}$ as discussed above, the minimally acceptable capacitor 304 voltage, $V_{404MIN}$, is calculated to be $V_{404MIN}=V_{MAX_THRESH}-V_{CC}=4.5-3.2=1.3$ volts, which during the second phase of operation changes sign to −1.3 volts. Accordingly, any voltage developed across capacitor 404 between 1.3 volts and a maximum voltage substantially equal to $V_{CC}$ is adequate to illuminate LED 416. Driver 402, in combination with capacitor 404, therefore, are said to be boosting the voltage at node 420 to any value between $V_{MAX_THRESH}$ and substantially $-V_{CC}$ in order to achieve a luminescent state of LED 416.

Figure 5:
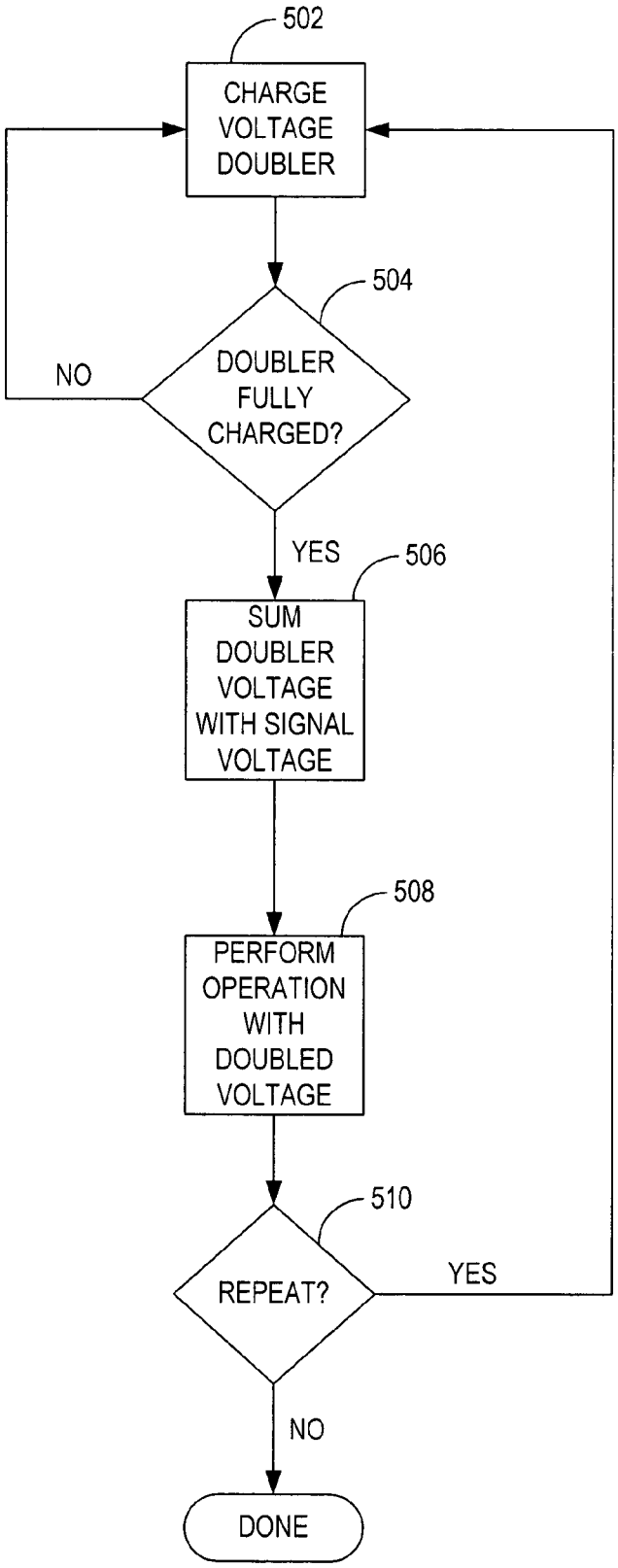
FIG. 5 is a flow chart illustrating the operation of the driver circuits of FIGS. 3 and 4.

FIG. 5 illustrates a flow chart of a method employing a modulated voltage doubler according to the present invention. A voltage doubler is charged with a modulated charging signal in block 502, where the voltage doubler employs an energy storage device, such as a capacitor. The modulated charging signal includes a binary voltage, where the capacitive doubler charges during one of the polarities of the modulated charging signal. An amount of time, $T=(C/i)*dV$, is given for the charging phase, where i is the amount of constant current used to charge the voltage doubler, C is the value of capacitance associated with the voltage doubler, and dV is the predetermined change in voltage across the capacitive storage device that is desired during the charging phase. If the correct amount of time has transpired as determined at decision block 504, then the YES branch is taken to block 506, otherwise, the capacitive doubler continues to charge 502.

Once the capacitive doubler has charged to an acceptable value, the stored voltage is added to a signal voltage as shown at block 506 to substantially double the amount of signal voltage available. The resulting voltage is utilized for the desired purpose as shown at block 508, which in one embodiment of the invention is to drive one or more LEDs. As the substantially doubled voltage is utilized, however, the stored voltage begins to decay according to the relation $dV=(i*dT)/C$, where dV is the change in stored voltage, i is the current delivered by the capacitive doubler, dT is the amount of time that the doubled voltage is utilized, and C is the capacitance associated with the capacitive doubling device. Once the stored voltage has decayed to a predetermined value, the charging process may terminate, or may repeat as depicted by return path to block 502.

Thus, the flow diagram of FIG. 5 depicts that two phases of operation exist in the illustrated embodiment. A first phase including blocks 502 and 504 charges a capacitive storage device to a predetermined level, while a second phase of operation including blocks 506 and 508 utilizes a doubled voltage until the stored voltage decays to a predetermined level. Once decayed, the process repeats to provide a modulated LED output capable of providing sufficient aggregate light for purposes of backlighting a display.

The flowchart of FIG. 5 may be related to the operation of LED controllers, such as LED controller 300 of FIG. 3 or LED controller 400 of FIG. 4, in the following manner. With regard to FIG. 3, charging of the voltage doubler is performed during the first phase of operation of LED controller 300, where the voltage doubler is implemented using capacitor 304. An amount of time is provided by the modulated charging voltage at node 322, such that the charging voltage is preserved in a logic low state until the voltage across capacitor 304 achieves a value substantially equal to $V_{CC}$, as in blocks 502 and 504.

Once charged, a second phase of operation is initiated in which the voltage developed across capacitor 304 is summed with the output voltage signal of driver 302 in the active high state, as in block 506. The summation of voltages yields a voltage that is substantially equal to $2*V_{CC}$ at node 320. The doubled voltage at node 320 is then used to forward bias LED 316 into its luminescent state, in order to provide the required backlighting for LCD 208 of FIG. 2, while the voltage at node 322 establishes the constant forward current conducted by LED 316 during its luminescent state, as in block 508. An amount of time is provided by the modulated discharging voltage at node 322, such that the discharging voltage is maintained in a logic high state during the second phase of operation. The discharging voltage activates a constant current source, which regulates the forward current required by LED 316 in its luminescent state, while discharging capacitor 304. Once the voltage across capacitor 304 has reached a predetermined minimum value, phase one operation is reentered, thus initiating the recharge of capacitor 304, as in block 502.

In conclusion, a method, system and apparatus is presented that facilitates operation of electronic devices using power supply voltage levels that are below the operating voltage limits of the electronic devices. More particularly, the present invention is particularly beneficial for use in an LED backlight controller of an LCD display.

The foregoing description of various embodiments of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A driver circuit, comprising:

a voltage booster coupled to receive an input voltage and coupled to provide an output voltage having an increased magnitude relative to the input voltage;

a current source coupled to receive the input voltage and to provide a substantially constant current in response to the input voltage, the current source comprising a bias generation circuit coupled to provide a bias voltage in response to the input voltage and a current conduction device coupled to receive the bias voltage and coupled to provide the substantially constant current in response to the bias voltage; and a component coupled to the voltage booster and the current source, wherein the voltage booster activates the component using the output voltage and the substantially constant current.

2. The driver circuit of claim 1, wherein the voltage booster comprises:

a buffer coupled to provide a charging signal in response to a first polarity of the input voltage; and an energy storage device coupled to receive the charging signal to increase a voltage developed across the energy storage device.

3. The driver circuit of claim 2, wherein the buffer is further coupled to provide a driving signal in response to a second polarity of the input voltage, the driving signal being combined with the voltage developed across the energy storage device to produce the output voltage.

4. The driver circuit of claim 1, wherein the component includes a light emitting diode (LED) having an illumination state controlled by the voltage booster.

5. The driver circuit of claim 1, wherein the bias generation circuit comprises a series combination of diodes.

6. The driver circuit of claim 5, wherein the current conduction device comprises a transistor having a voltage across a control terminal and a conduction terminal of the transistor substantially equal to a voltage across one of the diodes.

7. The driver circuit of claim 6 further comprising a current limiting device, wherein the current limiting device limits the substantially constant current to be proportional to the voltage across one of the diodes.

8. The driver circuit of claim 4, wherein a forward current conducted by the LED is substantially equal to the substantially constant current.

9. A method of controlling a luminescent state of a Light Emitting Diode (LED), comprising:

receiving an input signal;

boosting the input signal to form a boosted signal, comprising:

generating a charging signal in response to a first phase of the input signal;

increasing a potential stored across an energy storage device in response to the charging signal; and combining the input signal with the potential stored across the energy storage device in response to a second phase of the input signal;

generating a substantially constant current from the input signal, comprising:

forming a bias signal in response to the second phase of the input signal; and inducing a conductive state of a current control device in response to the bias signal, wherein the substantially constant current is proportional to the bias signal; and applying the boosted signal and the substantially constant current to illuminate the LED.

10. A method of controlling backlighting associated with a display, comprising:

storing charge from a power source in a first phase of operation when a bias voltage supplying at least one Light Emitting Diode (LED) is less than a forward voltage required by the LED, wherein the power source provides a voltage level lower than the forward voltage required by the LED;

in a second phase of operation, combining an operating voltage with the stored charge to illuminate the LED using the combined voltage as the bias voltage; and alternating the first and second phases of operation to control the backlighting associated with the display.

11. The method of claim 10, wherein storing charge comprises providing a charging signal from the power source to an energy storage device by conducting the charging signal using a driver.

12. The method of claim 11, where the driver conducts the charging signal in response to a first polarity of an illumination signal.

13. The method of claim 12, wherein the operating voltage is provided by the driver operating in response to a second polarity of the illumination signal.

14. The method of claim 10, wherein the LED is non-luminescent in the first phase of operation.

15. The method of claim 14, wherein the LED is luminescent in the second phase of operation.

16. The method of claim 15, wherein a perceived intensity of the LED is proportional to a duty cycle formed by the second phase and the first phase.

17. An environmental control system, comprising:

a display controller coupled to the environmental control system to provide display information;

a thermostat comprising an LCD coupled to receive the display information, and an LCD backlight system coupled to the LCD, the LCD backlight system comprising:

a voltage booster coupled to receive a lighting control signal and coupled to provide an output signal having an increased magnitude of the lighting control signal;

a current source coupled to receive the lighting control signal and coupled to provide a substantially constant current in response to the lighting control signal; and a Light Emitting Diode (LED) coupled to the voltage booster and the current source, wherein the voltage booster activates the LED using the output signal and the substantially constant current.

18. The environmental control system of claim 17, wherein the voltage booster comprises:

a buffer coupled to provide a charging signal in response to a first polarity of the lighting control signal; and an energy storage device coupled to receive the charging signal to increase a voltage developed across the energy storage device.

19. The environmental control system of claim 18, wherein the buffer is further coupled to provide a driving signal in response to a second polarity of the lighting control signal, the driving signal being combined with the voltage developed across the energy storage device to produce the output signal.

20. The environmental control system of claim 17, wherein a forward current conducted by the LED is substantially equal to the substantially constant current.

21. The environmental control system of claim 17, wherein the bias generation circuit comprises a series combination of diodes.

22. The environmental control system of claim 21, wherein the current conduction device comprises a transistor, wherein a voltage across a control terminal and a conduction terminal of the transistor is substantially equal to a voltage across one of the diodes.

23. The environmental control system of claim 22 further comprising a current limiting device, wherein the current limiting device limits the substantially constant current to be proportional to the voltage across one of the diodes.

24. A Light Emitting Diode (LED) control circuit, comprising:

means for storing charge from a power source in a first phase of operation when a bias voltage supplying at least one Light Emitting Diode (LED) is less than a forward voltage required by the LED, wherein the power source provides a voltage level lower than the forward voltage required by the LED;

means for combining, in a second phase of operation, an operating voltage with the stored charge to illuminate the LED using the combined voltage as the bias voltage; and means for alternating the first and second phases of operation to control the backlighting associated with the display.

* * * * *